US011913747B2

(12) United States Patent
Fausti et al.

(10) Patent No.: US 11,913,747 B2
(45) Date of Patent: Feb. 27, 2024

(54) BASE PAD FOR MAGAZINE AND MAGAZINE GROUP

(71) Applicant: MEC-GAR S.R.L., Gussago (IT)

(72) Inventors: Piergiacomo Fausti, Gussago (IT); Stefano Fausti, Gussago (IT); Elia Milani, Gussago (IT)

(73) Assignee: MEC-GAR S.R.L., Gussago (IT)

( * ) Notice: Subject to any disclaimer, the term of this patent is extended or adjusted under 35 U.S.C. 154(b) by 318 days.

(21) Appl. No.: 17/423,595

(22) PCT Filed: Jan. 17, 2020

(86) PCT No.: PCT/IB2020/050371
§ 371 (c)(1),
(2) Date: Jul. 16, 2021

(87) PCT Pub. No.: WO2020/148716
PCT Pub. Date: Jul. 23, 2020

(65) Prior Publication Data

US 2022/0107148 A1 Apr. 7, 2022

(30) Foreign Application Priority Data

Jan. 18, 2019 (IT) ..... 102019000000811

(51) Int. Cl.
*F41A 9/65* (2006.01)
*F41A 9/71* (2006.01)

(52) U.S. Cl.
CPC .. *F41A 9/65* (2013.01); *F41A 9/71* (2013.01)

(58) Field of Classification Search
CPC ..... F41A 9/65–71; F41A 23/04
See application file for complete search history.

(56) References Cited

U.S. PATENT DOCUMENTS 4,862,619 A 9/1989 Baldus et al.
D344,780 S * 3/1994 Jenkins ..... D22/108
5,293,708 A * 3/1994 Strayer ..... F41C 23/10 42/71.02
5,526,600 A * 6/1996 Chesnut ..... F41A 9/65 42/50

(Continued)

FOREIGN PATENT DOCUMENTS

DE 20119940 U1 2/2002

OTHER PUBLICATIONS

European Patent Office, International Search Report issued in PCT/IB2020/050371, dated Mar. 5, 2020, Rijswijk, NL.

(Continued)

*Primary Examiner* — Gabriel J. Klein
(74) *Attorney, Agent, or Firm* — Ferguson Case Orr Paterson

(57) ABSTRACT

A base pad for a firearm magazine is provided. The base pad has a base pad body made in one piece. The base pad body has a body base and a peripheral wall, protruding peripherally from the body base. The body base and the peripheral wall delimit a body compartment configured to face a lower end of the firearm magazine. Anchoring means for anchoring the base pad to the firearm magazine are provided on the peripheral wall, on a side of the body compartment. Fins, spaced apart from each other, are provided in the peripheral wall, on an outer side, opposite to the side of the body compartment.

14 Claims, 5 Drawing Sheets

(56) References Cited

U.S. PATENT DOCUMENTS

| | | | | |
|---|---|---|---|---|
| 9,587,905 | B1 * | 3/2017 | Biedenbach | F41C 23/16 |
| 10,520,268 | B1 * | 12/2019 | Viani | F41A 11/00 |
| 10,852,086 | B1 * | 12/2020 | Hillis | F41A 9/71 |
| 11,662,165 | B1 * | 5/2023 | Viani | F41A 9/65 42/50 |
| 2002/0029506 | A1 * | 3/2002 | Wollmann | F41A 9/71 42/50 |
| 2014/0068992 | A1 * | 3/2014 | Keng | F41A 23/04 42/94 |
| 2018/0347929 | A1 * | 12/2018 | Hsu | F41A 9/71 |
| 2019/0195591 | A1 * | 6/2019 | Keng | F41C 27/22 |

OTHER PUBLICATIONS

European Patent Office, International Written Opinion issued in PCT/IB2020/050371, dated Mar. 5, 2020, Rijswijk, NL.

* cited by examiner

BASE PAD FOR MAGAZINE AND MAGAZINE GROUP

CROSS-REFERENCE TO RELATED APPLICATIONS

This application is a National Phase Application of PCT International Application No. PCT/IB2020/050371, having an International Filing Date of Jan. 17, 2020 which claims the benefit of priority to Italian Patent Application No. 102019000000811, filed Jan. 18, 2019, each of which is hereby incorporated by reference in its entirety.

FIELD OF THE INVENTION

The subject-matter of the present invention is a base pad for a firearm, in particular a base pad for a magazine for handguns.

BACKGROUND OF THE INVENTION

As is known, a magazine comprises a prismatic-shaped magazine tube inside of which the bullets are housed, superimposed vertically. On the bottom of the magazine tube there is placed a removable base pad for normal maintenance and cleaning operations of the magazine.

Generally, the base pad is inserted in the end of the magazine tube, according to a direction of engagement that goes from the front area towards the rear area. The base pad is then removed by pulling it out of the magazine tube in one direction from the rear area to the front area.

In normal use, the magazine is inserted into the barrel of the firearm.

As one may understand, it is extremely important for the base pad not to separate accidentally from the magazine tube and especially not to encounter breakages as a result of shocks or other sudden and unpredictable external actions.

In order to test the reliability of the connection between the base pad and the magazine tube, the magazine alone and the firearm equipped with the magazine are subjected to a number of tests, in which the magazine and/or the firearm are dropped onto a detection plane from a predefined height (so-called "drop test").

The tests conducted have shown that the impact between the magazine and the detection plane generally occurs at the rear area of the base pad, most likely due to the usual distribution of the mass.

There is therefore a high risk that the base pad will disengage from the magazine tube or otherwise be damaged by the impact.

SUMMARY OF THE INVENTION

The object of the present invention is to construct a base pad that satisfies the requirements of the sector and at the same time overcomes the drawbacks mentioned above.

This object is achieved by a base pad and a magazine group according to the accompanying independent claims. The dependent claims define further advantageous embodiments of the invention.

BRIEF DESCRIPTION OF THE DRAWINGS

The features and advantages of the base pad and magazine group according to the present invention will be apparent from the description given below, provided by way of non-limiting example, in accordance with the accompanying figures, wherein.

DETAILED DESCRIPTION

Figure 1:
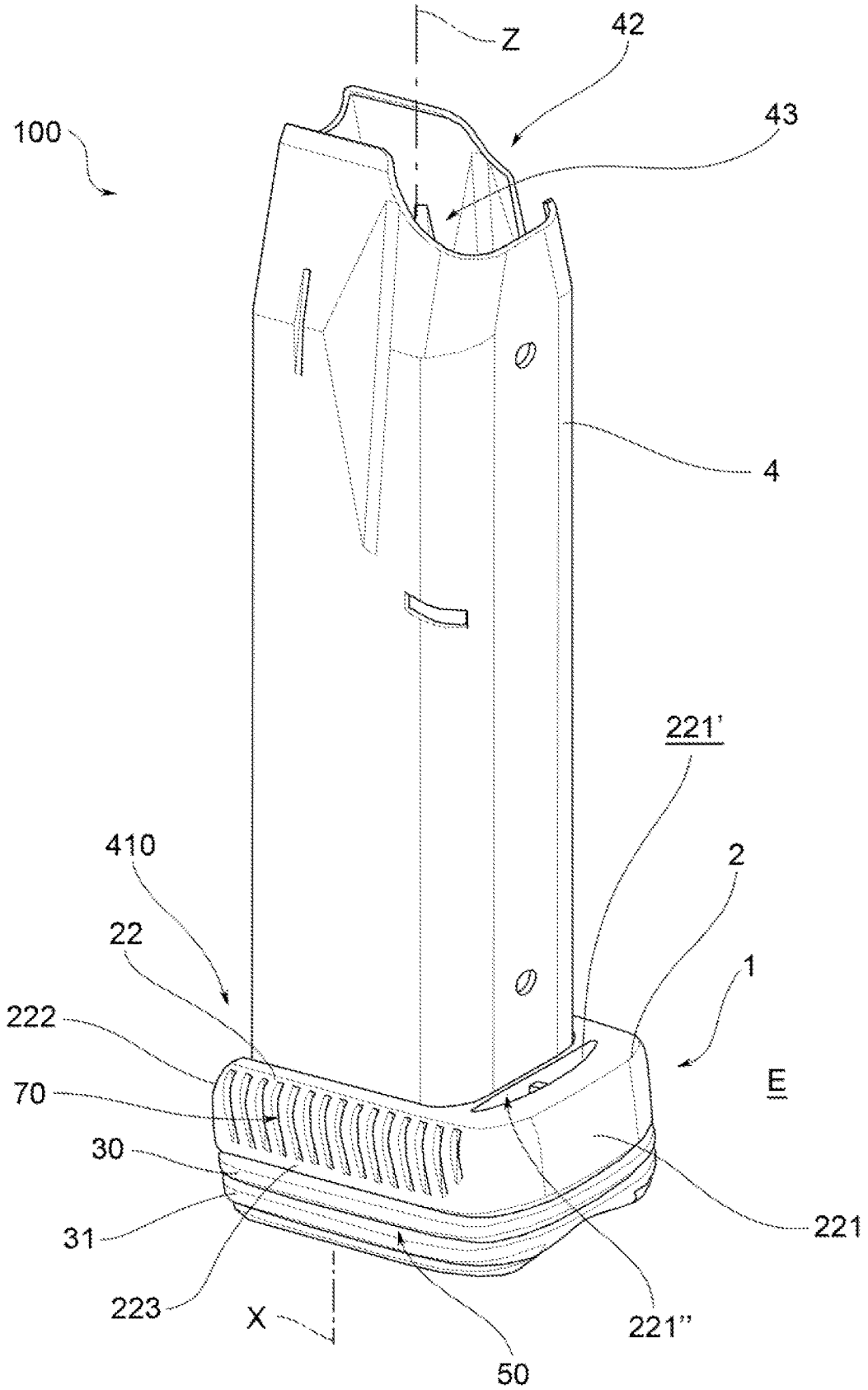
FIG. 1 depicts a magazine group, which comprises a base pad installed on a magazine, according to an embodiment of the present invention.
Figure 2:
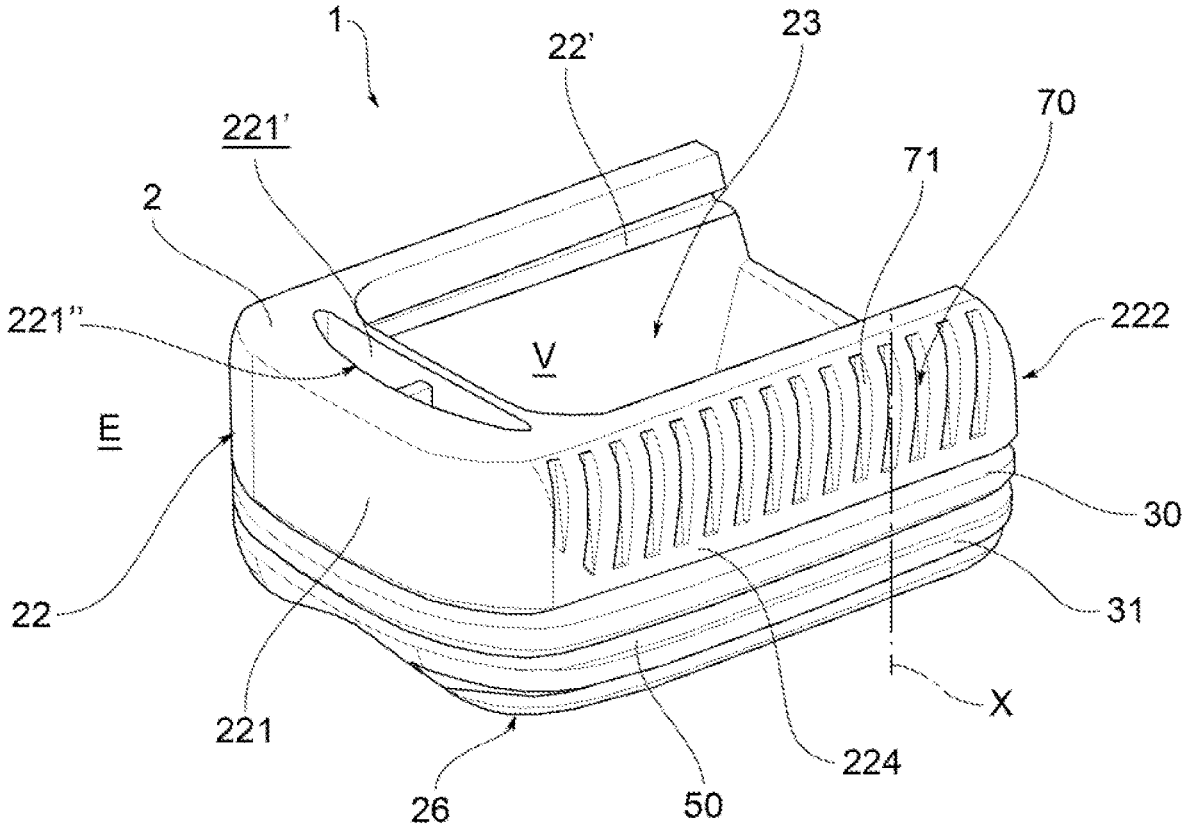
FIG. 2 depicts a partial perspective view of a base pad according to an embodiment of the present invention.
Figure 6:
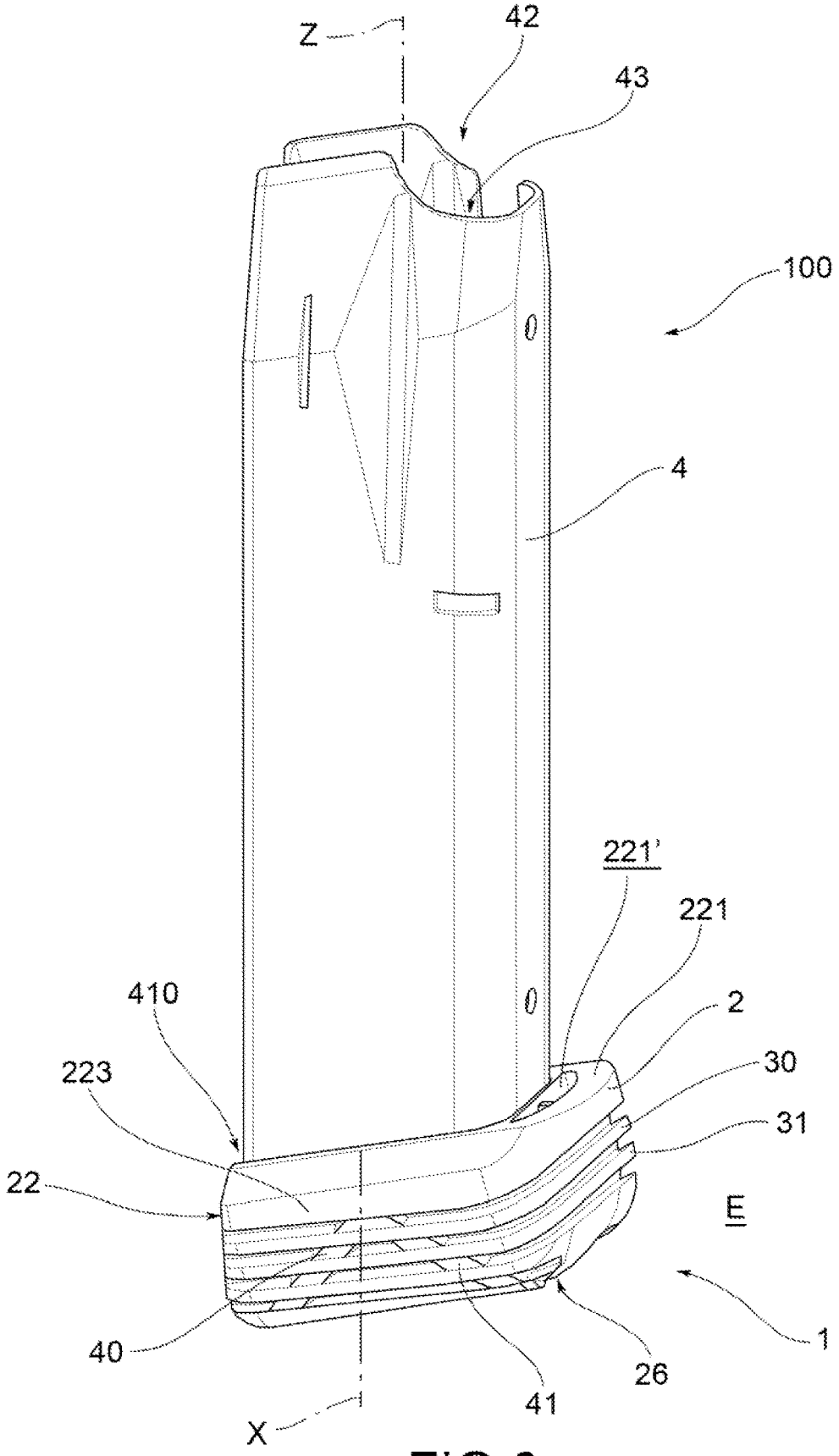
FIG. 6 depicts a magazine group, which comprises a base pad installed on a magazine, according to a second embodiment of the present invention.

With reference to the accompanying tables, FIGS. 1 and 6 illustrate respectively a first embodiment and a second embodiment of a base pad 1 for a firearm magazine according to the present invention, coupled to a magazine 4. The base pad 1 may be coupled to any type of magazine either a single-row magazine, i.e. capable of containing therein a single row of superimposed bullets, or a two-row magazine, i.e. capable of containing therein two rows of superimposed bullets, staggered side-by-side.

The magazine 4 comprises a magazine tube, usually made from a bent sheet, prismatic in shape with a predominant extension along a main axis Z, between a lower end 410 and an upper end 42.

The magazine tube comprises a side wall that encloses therein a compartment 43 to house the bullets.

The base pad 1 for a firearm magazine 4, according to the present invention, is thus suitable to be coupled in a releasable way to a lower end 410 of a magazine 4. This base pad 1 comprises a base pad body 2 made in one piece.

Preferably, the base pad body 2 or the entire base pad 1 is made of plastic material, e.g. polyethylene or polypropylene or polyamide, preferably by injection molding or by 3D additive printing technology.

The base pad body 2 comprises a body bottom 21 and a peripheral wall 22, which protrudes peripherally from the body bottom 21, whereby the body bottom 21 and the peripheral wall 22 delimit a body compartment 23 suitable to face the lower end 410 of the magazine 4.

On this peripheral wall 22, on the side of the body compartment 23, there are provided means for anchoring the base pad 1 to the magazine 4.

Preferably, the anchoring means comprise at least one groove 22', 22" obtained in the peripheral wall 22 on the side V of the body compartment 23. The groove(s) 22', 22" are shaped to allow the magazine to slide into this groove 22', 22", more specifically to allow one or more portions of the lower end 410 of the magazine to engage slidingly within the groove(s) 22', 22".

The peripheral wall 22, from the outer side E, i.e. the side opposite to the side (V) of the body compartment (23), comprises fins 30, 31 spaced apart from each other, so as to absorb or better distribute any accidental impacts in case the magazine-base pad group is dropped.

Preferably, between the fins 30, 31 there is at least one groove 50 obtained in the peripheral wall 22 on the outer side E.

In a particularly advantageous embodiment, the fins 30, 31 are spaced apart from each other along a vertical direction X substantially perpendicular to the body bottom 21. This allows a shock acting on a main component in the vertical direction X to be better absorbed.

As clearly illustrated in the accompanying figures, preferably, the peripheral wall 22 comprises a peripheral front section 221, a peripheral rear section 222 and peripheral sides 223, 224 with longitudinal extension between the peripheral front section 221 and the peripheral rear section 222. In other words, the peripheral wall takes on a substantially box-like shape, i.e. a parallelepiped. In this shape, the longitudinal direction is perpendicular to the vertical direction X.

Preferably, the fins 30, 31 project at least from the peripheral sides 223, 224.

Furthermore, preferably, the fins 30, 31 project from both the peripheral sides 223, 224 and from the front peripheral section 221.

In an embodiment in accordance with the invention, the fins 30, 31 run continuously at least along the front peripheral section 221 and the peripheral sides 223, 224 around the body compartment 23.

Furthermore, in a further variant (not shown), the fins 30, 31 run continuously along at least the front peripheral section 221, the rear peripheral section 222 and the peripheral sides 223, 224.

Preferably, the fins 30, 31 lie on planes P1, P2 substantially parallel to the body bottom 21, spaced apart from each other, preferably along the vertical direction X.

In a variant embodiment (not shown), the resulting gap S between the fins is filled with a polymeric filler material, which is different from the material used to make the base pad body 2. Preferably the filler material is a silicone or elastomeric material. This makes it possible to absorb shocks due to impact even more effectively.

In an embodiment in accordance with the invention, the base pad body 2 further comprises vertical fins 70, spaced apart from each other, which extend mainly along an inclined direction relative to the fins 30, 31. Preferably the vertical fins 70 extend mainly along a vertical direction X, perpendicular to the main direction of extension of the fins 30,31, for example the vertical fins 70 extend along a direction perpendicular to the body bottom 21. Preferably, the vertical fins 70 result from making vertical grooves 71, obtained in the base pad body 2. Therefore, the vertical fins 70, are alternated with the vertical grooves 71.

Figure 7:
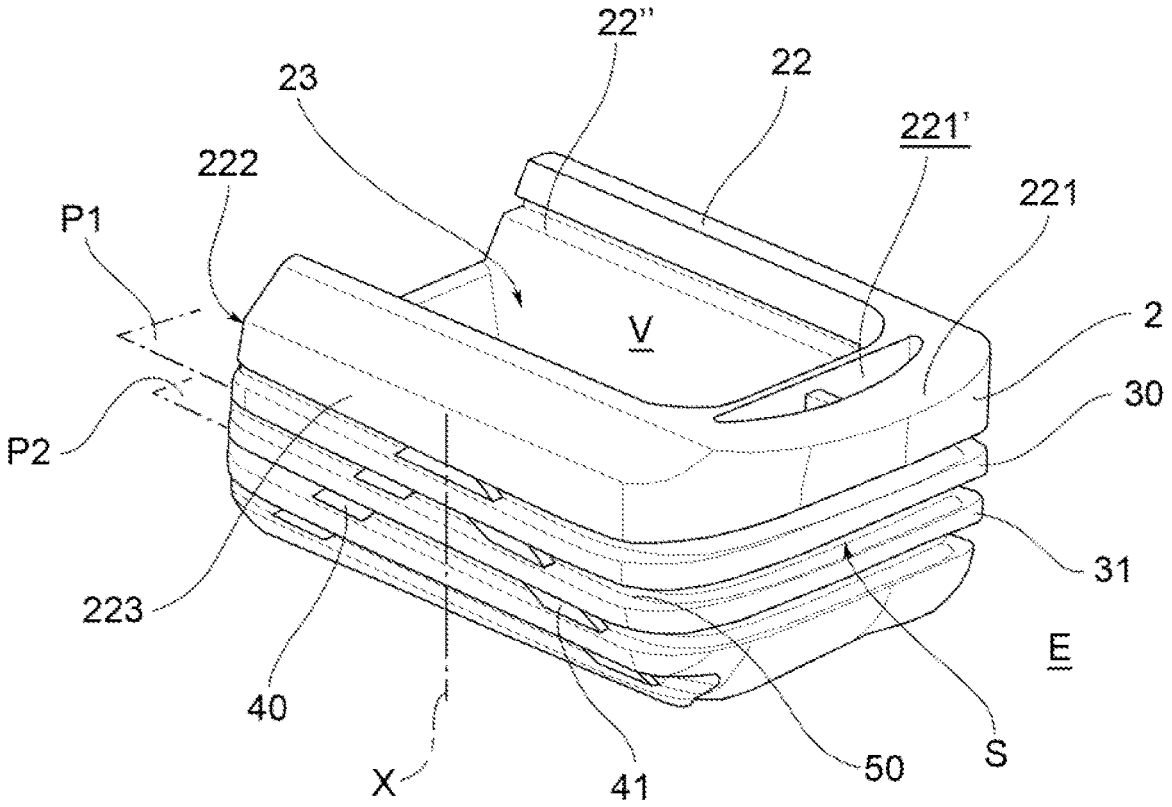
FIG. 7 depicts a perspective view of a base pad according to a second embodiment of the present invention.
Figure 8:
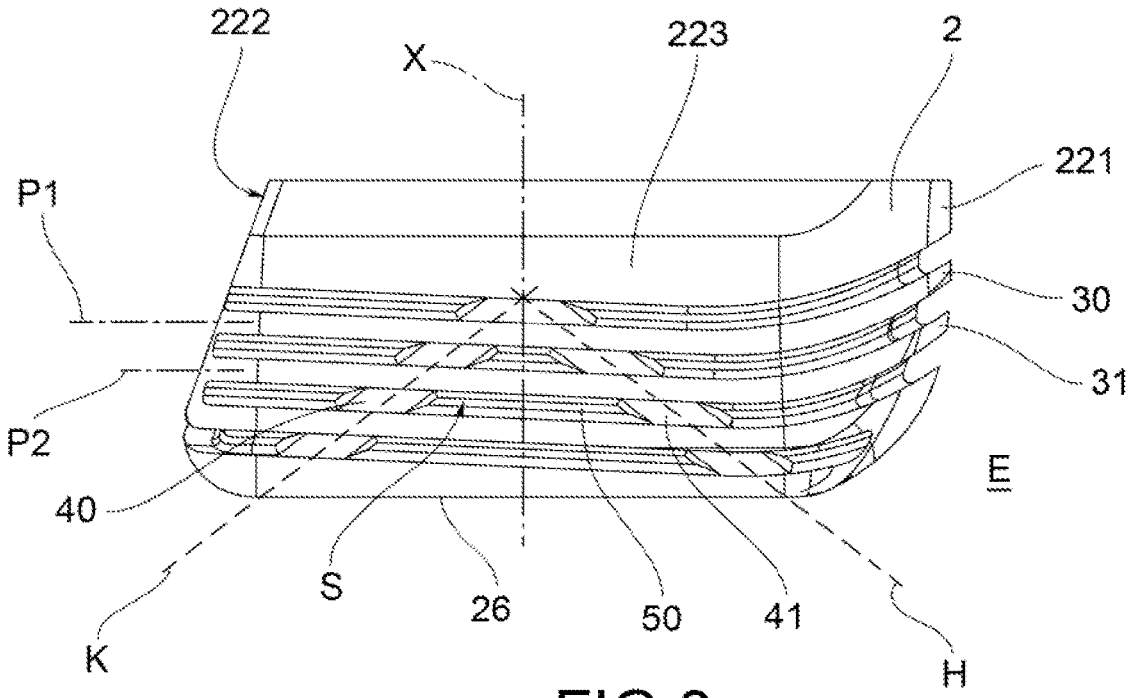
FIG. 8 depicts a side elevation view of the base pad in FIG. 7.

Furthermore, according to a preferred variant embodiment, for example shown in FIGS. 6 to 8, the base pad comprises at least one connecting rib 40, 41, which connects two or more fins 30, 31 to each other.

Preferably, the connecting rib 40, 41 extends mainly along a rib direction K, H inclined relative to the direction of greater extension of the fins 30, 31. For example, the connecting rib 40, 41 extends along a rib direction K, H inclined relative to a direction parallel or perpendicular to the body base 21.

Preferably, the base pad comprises two connecting ribs 40, 41, preferably connected to each other, as shown in FIGS. 6 to 8. In particular, a first connecting rib 40 of these connecting ribs 40, 41 extends along a first inclined rib direction H and the second connecting rib 40, 41 extends along a second inclined rib direction K, intersecting the first inclined direction H.

Preferably, in this variant, the connecting ribs are arranged along the peripheral sides 223, 224. Preferably, the connecting ribs form an inverted "V" shape, i.e. with the tip pointing towards the top end 42 of the magazine 4, when the magazine is inserted into the body compartment 23.

Preferably, the connecting rib 40, 41 has a smaller thickness than the thickness of the fins 30, 31. This thickness is calculated as the distance from the bottom wall of the groove 50.

In one embodiment in accordance with the invention, the base pad comprises an outer concave base surface 26, opposite the body bottom 21. The concavity of the outer concave base surface 26 faces outwards E, i.e. the concave region faces away from the body bottom 21.

Figure 3:
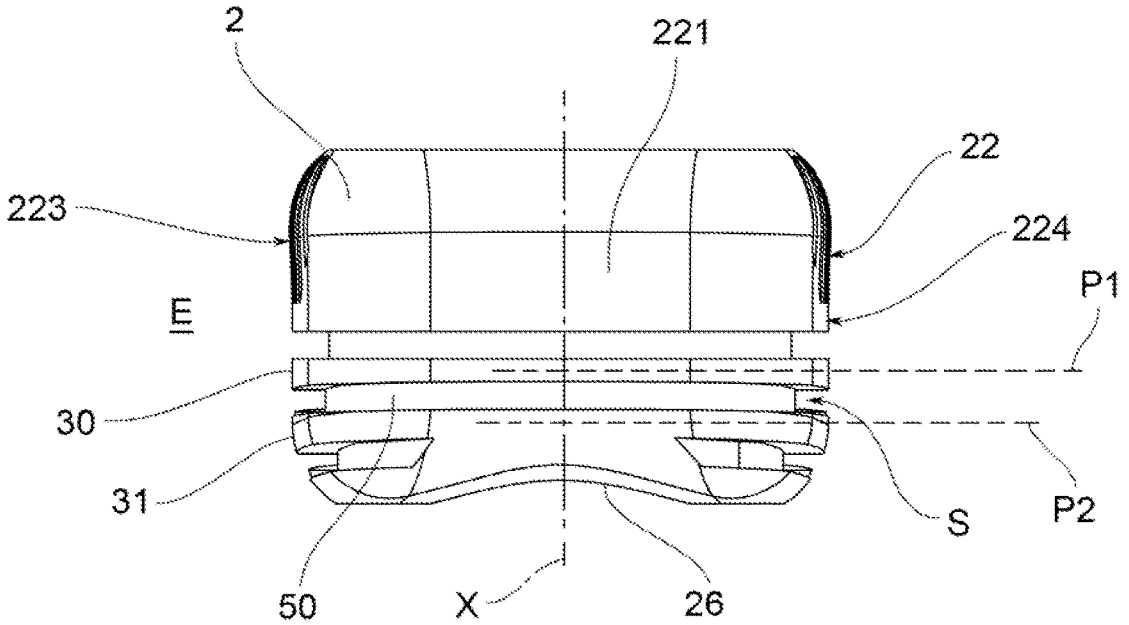
FIG. 3 depicts a front elevation view of the base pad in FIG. 2.
Figure 4:
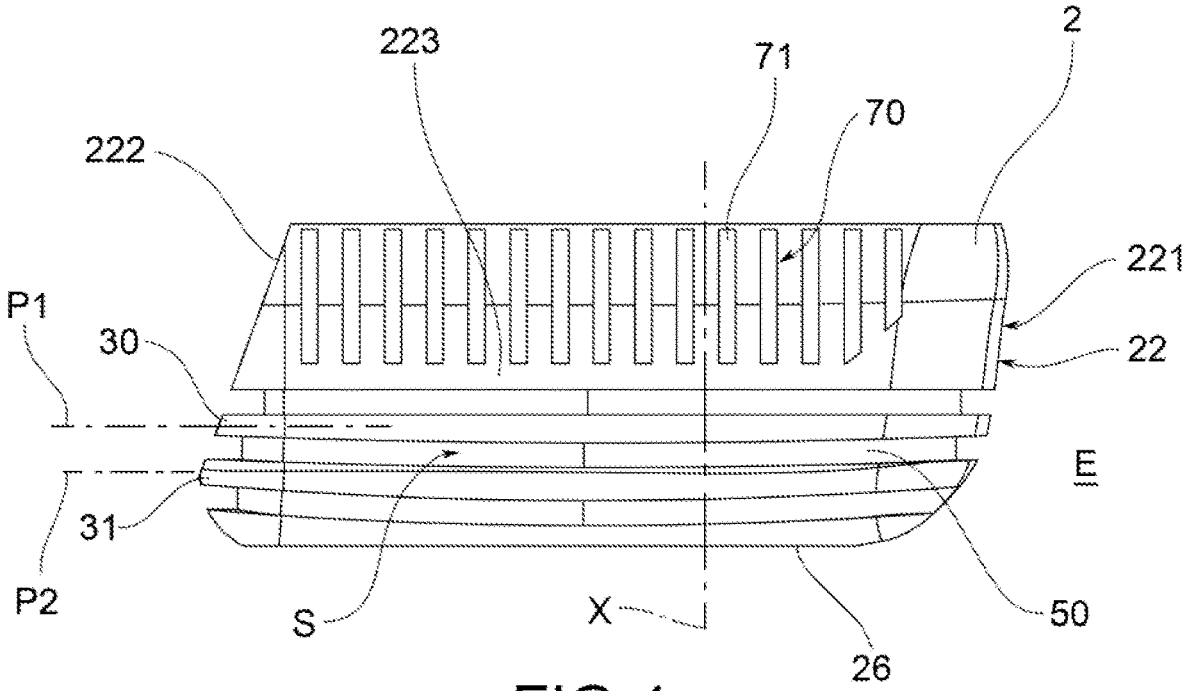
FIG. 4 depicts a side elevation view of the base pad in FIG. 2.
Figure 5:
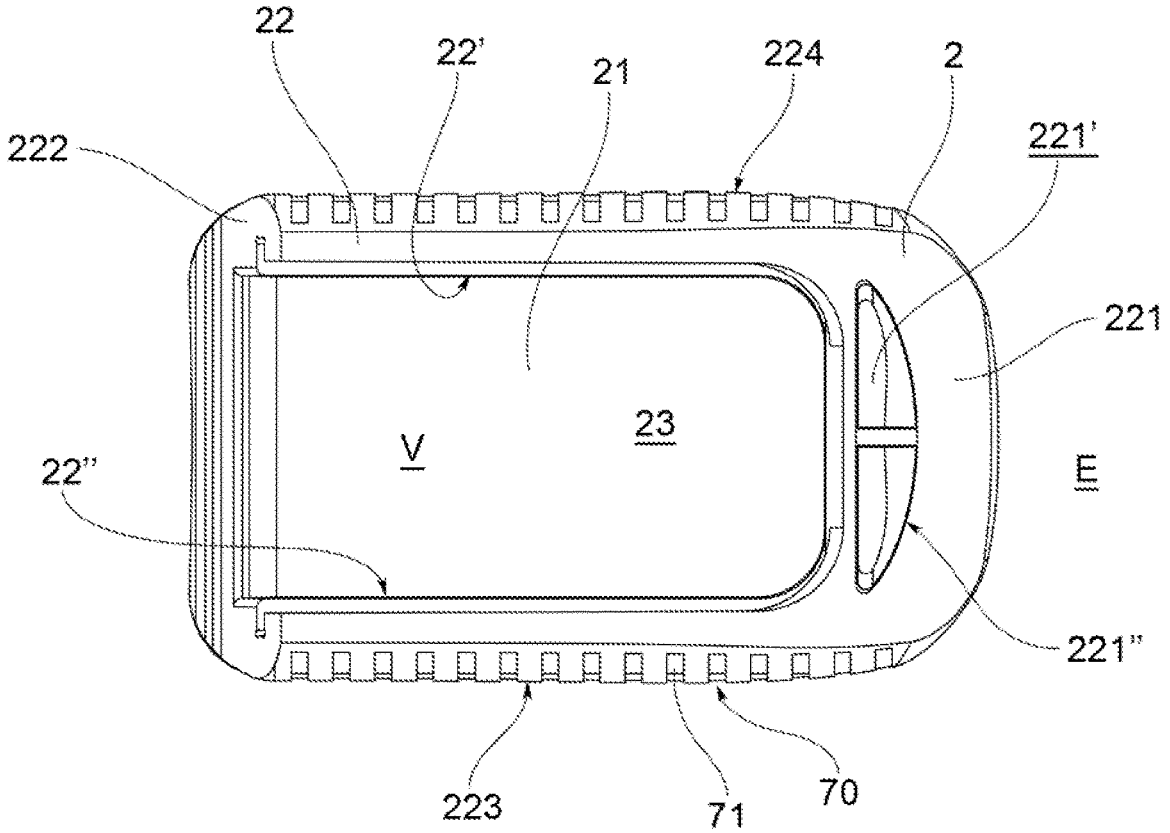
FIG. 5 shows a plan view from above of the base pad in FIG. 2.

In particular, as clearly visible for example in FIG. 3, the outer base surface 26 has preferably a hyperbolic or parabolic or inverted "U" or inverted "V" shape, which connects with continuity to the peripheral sides 223 and 224, preferably with a single span. This geometry of the outer base surface 26 contributes surprisingly to the increased impact resistance of the base pad, due to an improved distribution of impact forces.

In one embodiment, the front peripheral section 221 comprises a front cavity 221', obtained in the peripheral wall, preferably communicating with the outer side E only from an upper opening facing the magazine 4, when the magazine is installed in the base pad 1.

It is clear that the present invention is also aimed at a magazine group 100 comprising a base pad 1 described above and a magazine 4 coupled to the base pad 1.

Preferably, the magazine 4 is inserted into the base pad 4 by sliding in the grooves 22', 22", arranged longitudinally, a pair of fins (not shown) of the magazine 4 placed on the lower end 410 of the magazine 4.

Preferably, the base pad 1 has collectively a wrap-around shape, able to wrap around the lower end 410 of the magazine 4 when coupled thereto.

Innovatively, the base pad according to the present invention overcomes the drawbacks mentioned with reference to the prior art.

In particular, advantageously, due to the presence of spaced apart fins, when the magazine group falls, the base pad striking a rigid surface, this impact is adequately absorbed or damped so as to cause neither the disengagement of the base pad nor the breakage of the base pad itself.

Advantageously, moreover, the robustness is at the same time guaranteed through an ergonomic and compact shape. In effect, the assembly of the base pad is particularly easy, without compromising the impact resistance of the base pad.

It is apparent that one skilled in the art, in order to meet contingent needs, may make changes to the base pad described above, all contained within the scope of protection as defined by the following claims.

The invention claimed is:

1. A base pad for a firearm magazine, suitable for being releasably coupled to a lower end of the firearm magazine, said base pad comprising a base pad body made in one piece, wherein said base pad body comprises a body base and a peripheral wall, protruding peripherally from the body base, whereby the body base and the peripheral wall delimit a body compartment configured to face the lower end of the firearm magazine, wherein anchoring means for anchoring the base pad to the firearm magazine are provided on said peripheral wall, on a side of the body compartment, wherein said peripheral wall, on an outer side, opposite to the side of the body compartment, comprises fins, spaced apart from each other, wherein the base pad further comprises two connecting ribs, connected to each other, each connecting rib of the two connecting ribs connecting two or more fins together, wherein a first connecting rib of the two connecting ribs extends mainly along a first inclined rib direction and a second connecting rib of the two connecting ribs extends mainly along a second inclined rib direction that intersects the first inclined rib direction, wherein the first inclined rib direction and the second inclined rib direction are inclined relative to a direction of greater extension of the fins.

2. The base pad of claim 1, wherein the fins are spaced apart from each other along a vertical direction (X) perpendicular to the body base.

3. The base pad of claim 1, wherein the peripheral wall comprises a front peripheral section, a rear peripheral section and peripheral sides with longitudinal extension between the front peripheral section and the rear peripheral section, and wherein the fins project at least from the peripheral sides.

4. The base pad of claim 3, wherein the fins run continuously at least along the front peripheral section and the peripheral sides around the body compartment.

5. The base pad of claim 3, wherein the fins lie on planes parallel to the body base, spaced apart from each other.

6. The base pad of claim 1, wherein a gap resulting between the fins is filled with a polymeric material, different from the material with which the base pad body is made.

7. The base pad of claim 6, wherein the gap between the fins is filled with silicone or elastomeric material.

8. The base pad of claim 1, wherein the first inclined rib direction and the second inclined rib direction are inclined relative to a direction parallel or perpendicular to the body base.

9. The base pad of claim 1, wherein between the fins at least one groove is obtained in the peripheral wall on the outer side.

10. The base pad of claim 1, wherein the first connecting rib and the second connecting rib each have a thickness that is smaller than the thickness of the fins, the thickness of each of said first connecting rib and said second connecting rib being calculated as the distance from a bottom wall of the at least one groove.

11. The base pad claim 1, further comprising a concave outer base surface, opposite to the body base, wherein a concavity of the concave outer base surface faces outwards, away from the body base.

12. The base pad of claim 11, wherein the concave outer base surface has a hyperbolic or parabolic shape or an inverted U shape or an inverted V shape, which connects with continuity to the peripheral sides.

13. The base pad of claim 1, wherein the anchoring means comprise at least one groove obtained in the peripheral wall on the side of the body compartment, and configured to allow the firearm magazine to slide in said at least one groove.

14. A magazine group comprising a base pad according to claim 1 and a firearm magazine coupled to the base pad.

* * * * *